United States Patent [19]

Ballard

[11] Patent Number: 4,961,392

[45] Date of Patent: Oct. 9, 1990

[54] SELF-LOCKING MECHANICAL STEERING HELM

[75] Inventor: Elmer I. Ballard, Council Bluffs, Iowa

[73] Assignees: Jim Danbom; Jan Danbom, both of Milford, Iowa

[21] Appl. No.: 319,347

[22] Filed: Mar. 6, 1989

Related U.S. Application Data

[63] Continuation-in-part of Ser. No. 89,996, Aug. 27, 1987, abandoned.

[51] Int. Cl.[5] ..... B63H 25/10

[52] U.S. Cl. ..... 114/161; 114/144 R; 74/425; 74/500

[58] Field of Search ..... 114/144 R, 154, 155, 114/156, 157, 158, 159, 160, 161; 440/62; 74/480 B, 425, 500

[56] References Cited

U.S. PATENT DOCUMENTS

| | | | |
|---|---|---|---|
| 4,940 | 1/1847 | Reed | 114/158 |
| 4,977 | 8/1881 | Archer | 114/154 |
| 142,047 | 8/1873 | Shaw | 114/157 |
| 292,611 | 1/1884 | Adair | 114/159 |
| 465,896 | 12/1991 | Thomson . | |
| 549,219 | 11/1895 | Stoddart et al. . | |
| 577,931 | 3/1897 | Richardson . | |
| 1,155,022 | 9/1915 | Wilkinson . | |
| 2,525,240 | 10/1950 | Pierce | 114/155 |
| 3,206,998 | 9/1965 | Matz et al. | 74/501 A |
| 3,225,620 | 2/1965 | Dubin | 114/144 R |
| 3,815,537 | 6/1974 | Evans | 114/144 R |
| 4,014,281 | 3/1977 | Nemens | 114/160 |
| 4,054,102 | 10/1977 | Borst et al. | 440/62 |

FOREIGN PATENT DOCUMENTS

| | | | |
|---|---|---|---|
| 1593 | of 1885 | United Kingdom | 114/154 |

*Primary Examiner*—Sherman Basinger
*Assistant Examiner*—Thomas J. Brahan
*Attorney, Agent, or Firm*—Zarley, McKee, Thomte, Voorhees & Sease

[57] ABSTRACT

A self-locking mechanical steering helm for a boat includes a worm gear set having a worm fixed on the steering wheel shaft and a worm gear clustered with a cable sprocket for controlled the movement of the steering cable which extends to the outdrive of the boat.

8 Claims, 4 Drawing Sheets

SELF-LOCKING MECHANICAL STEERING HELM

CROSS-REFERENCE TO RELATED APPLICATION

This is a continuation-in-part application of Ser. No. 089,996 filed Aug. 27, 1987, entitled "Self-Locking Mechanical Steering Helm", now abandoned.

BACKGROUND OF THE INVENTION

The present invention is directed generally to a mechanical steering helm which can be mounted in the confined console space found on small class boats, where the helmsman has control of the boat. It is at this position wherein the single cable push-pull, flexible type steering cable originates. Normally, a steering wheel is operatively connected to a remote control head which is connected to the steering cable.

This invention pertains more specifically to a self-locking or non-reversible type of remote control steering head, one having the capability of holding a boat on a predetermined and set course. This remote control steering head will hold a boat on the last course steered to by the helmsman and will stay there should he be thrown out of the boat or become incapacitated.

In conventional mechanical helms, the steering wheel turns a shaft connected to a small spur gear which turns a larger spur gear connected to a cable sprocket for reeling in and paying out the steering cable in response to rotation of the steering wheel. The problem with the prior art arrangement is that such helms are freewheeling and susceptible to steering torque and back driving. The same problem also exists in conventional variations of the above-described mechanical helm, such as drum, rotary, or rack and pinion helm systems. Steering torque is produced by the turning of a boat propeller or by imperfections in the lower unit or outdrive or by maladjustment of the trim tab. Over the past twenty years many human lives have been lost because of the tendency of a boat with a mechanical steering helm to allow the propeller shaft torque to back drive the helm, causing steering course change.

It must be noted that with high power, high speed boats the relation of the helm to the rudder or stern drive must be in unison without any backlash or freeplay in the steering system to also eliminate chine walking, which is the rolling back and forth, port to starboard on the perimeter of the hull of the boat at the stern, and can be as life threatening as the loss of steering control.

The problem with all prior art arrangements is their adaptability to small class boats using a single cable push-pull flexible type of steering system and a remote control head. The incorporation of a worm-worm gear in the remote steering head of this invention, modifies the single cable push-pull steering system now on the market, so as to become non-reversible, or "self-locking".

All prior art pertaining to the single cable push-pull steering system, whether it be rotary or rack and pinion is reversible, although attempts have been made to eliminate back driving by placing an adjustable brake or friction device on the remote control head.

A primary object of the invention is to provide an improved remote steering system which is self-locking and non-reversible at all steering positions and not susceptible to problems of steering torque and back driving.

Another object is to provide an improved remote control steering head wherein a worm drives a worm gear in unison with a cable drive sprocket, drum or spool.

Another object is to provide an improved remote control steering head which eliminates steering torque for all trim positions of the motor or outdrive, regardless of the horsepower or type of propeller used.

Another object is to provide an improved remote control steering head which facilitates operation of a boat by physically handicapped or disabled persons.

Another object is to provide an improved remote control steering head which is safer by eliminating the tendency of a deserted boat to go into repeated looping circles.

Another object is to provide an improved remote control steering head which tends to lock an outboard or stern drive motor in its preset position during trailering of the boat, not allowing the motor to swing back and forth, possibly causing damage.

Finally, an object is to provide an improved remote control steering head which is simple and rugged in construction, easily adaptable from one boat to another, economical to manufacture, readily available as an after-market product and very easy to install by the boat owner.

SUMMARY OF THE INVENTION

The self-locking mechanical steering helm of the present invention includes a worm gear set including a worm fixed on one end of a worm shaft having a steering wheel affixed on the opposite end thereof. The worm is enclosed within a housing which likewise includes a worm gear in meshed relation with the worm and a cable sprocket secured to the worm gear for rotation in unison. The housing has a pair of cable guides arranged in parallel spaced-apart relation generally tangent to opposite edges of the cable sprocket for directing cable to and from the housing.

The helm of the present invention has a built-in safety factor. The worm gear set has a certain degree of self-locking ability pertaining to the worm gear not driving the worm. Accordingly, there is no movement of the steering wheel until it is manually caused to turn and change course. Should the operator be thrown out of the boat, the boat will not steer itself into a continuously repeated looping and closed circle coming back over the body in the water. Boats rigged with conventional helms have been equipped with an adjustable brake, tension adjustor or friction device to try and compensate for this problem, all of which cause increased wear and restrict ease of steering, but the helm of the present invention does not require such devices.

Another advantage of the helm of the present invention is that it contributes to safe trailering of a boat. When a boat having a conventional mechanical helm outboard motor is trailered, the motor tends to turn and swing back and forth, sometimes causing damage to the trailer or clamp bracket. The helm of this invention locks the motor in any set position and the motor remains in that position until such time that it is changed by turning the steering wheel manually.

DESCRIPTION OF THE PREFERRED EMBODIMENTS

Figure 1:
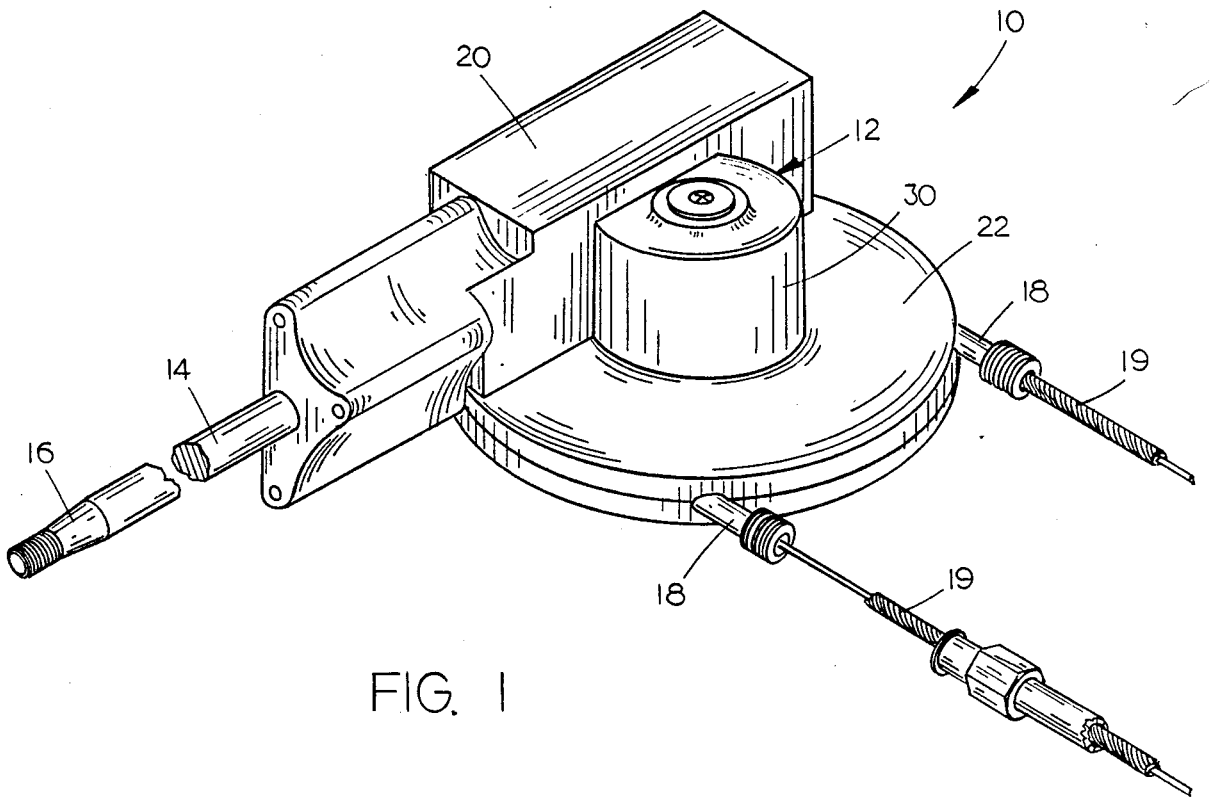
FIG. 1 is a perspective view of the mechanical helm of the invention.
Figure 2:
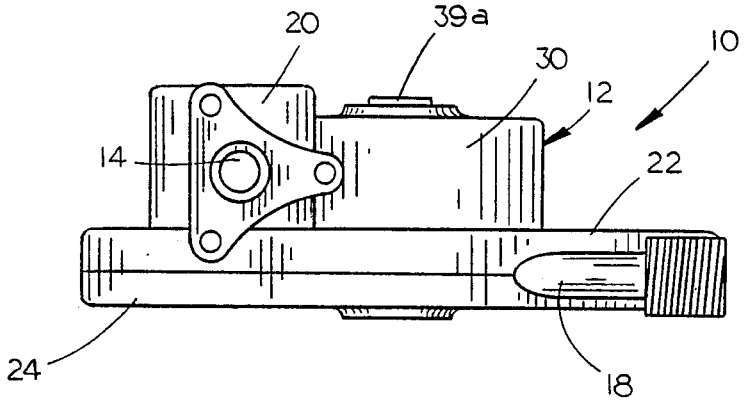
FIG. 2 is a side view of the helm.
Figure 3:
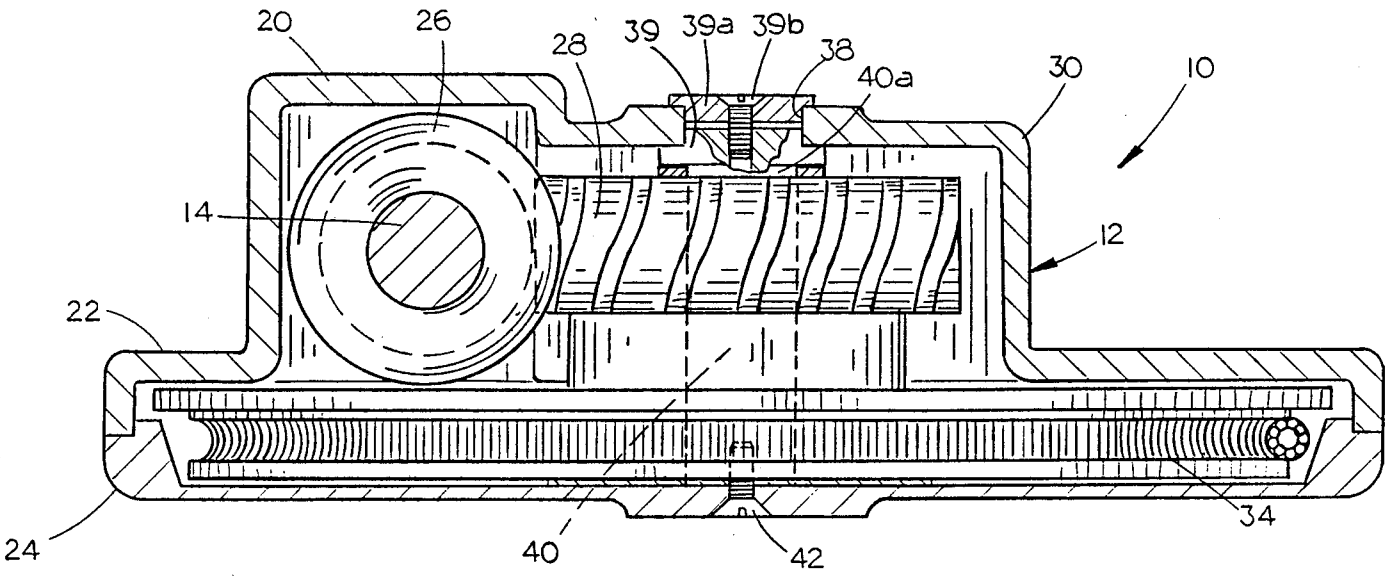
FIG. 3 is a side sectional view of the helm.

The self-locking mechanical steering helm 10 of the present invention is illustrated in FIG. 1–3 as including a housing 12 from which a worm shaft 14 extends outwardly for mounting the boat steering wheel on the threaded and tapered free end 16 thereof. A pair of cable guides 18 extend outwardly from housing 12 for guiding a steering cable 19 onto and about a cable sprocket 34 within the housing.

Cable 19 is a conventional push-pull flexible type steering cable which is longitudinally movable within a sheath 21. One end of sheath 21 is connected to housing 22 on the threads 23 of cable guide 18, and the other end is connected to a steerable drive unit in a conventional fashion, such that sheath 21 will not move as cable 19 is "pushed" or "pulled " therethrough.

Figure 5:
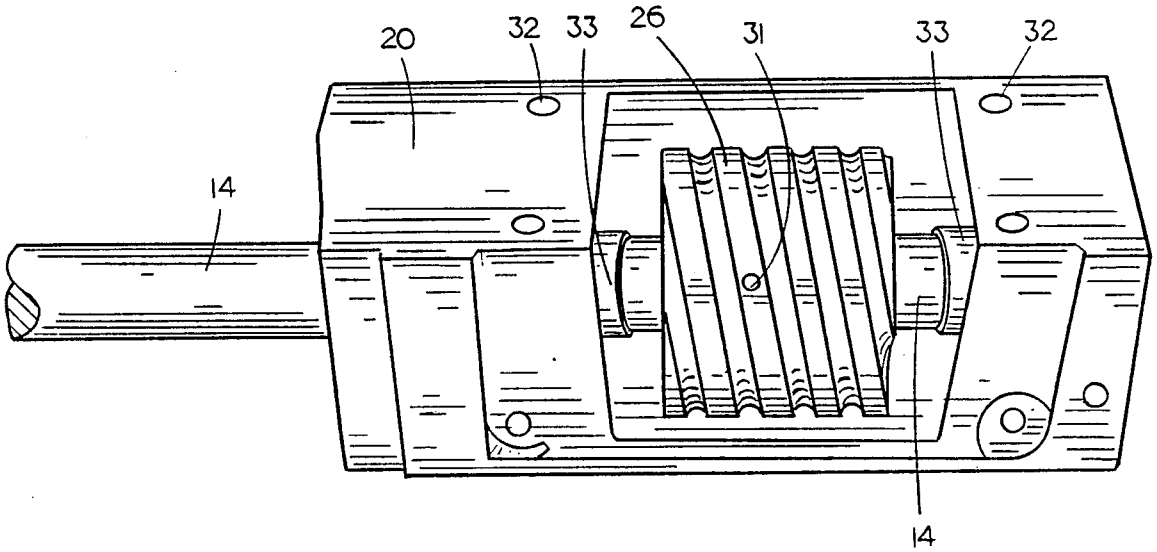
FIG. 5 is a perspective view of the worm shaft housing.

As shown best in FIGS. 2, 3, and 5, housing 12 includes three separate housings referred to as the worm shaft housing 20, upper rotor housing 22 and lower rotor housing 24. As shown in FIG. 5, the worm shaft housing 20 is open along two sides for exposure of the worm 26 to the worm gear 28 situated within a worm gear extension portion 30 of the upper rotor housing 22. The worm shaft housing 20 is secured to the upper rotor housing 22 by a series of four bolts inserted through holes 32 shown in FIG. 5.

In the illustrated embodiment, for example, the worm shaft 14 may be tapered, keyed shaft for receiving the boat steering wheel on the free end. The worm 26 is assembled onto the opposite end of the shaft 14 and pinned or otherwise secured to it for rotation in unison as indicated at 31 in FIG. 5. The worm shaft 14 rides in bushings 33 within the worm shaft housing 20 and thrust roller bearings may be provided on each side of the worm to eliminate side thrust pressure during operation. Bushings 33 may be replaced by bearings or any other friction reducing means as desired.

A matching worm gear 28 is clustered together on the same axis with a cable sprocket 34 for rotation in unison. The cluster may be integrally die cast or a separate gear 28 and sprocket 34 may be secured together by dowel pins or the like. The gears may be cut to the following specifications.

The following dimensions and specifications are not critical and are not to be construed as limiting the invention; they are simply given to provide a clear and complete description of the illustrated embodiment. The worm gear set has a 10-1 reduction. The worm gear 28 is 2½ inches in diameter and has a ⅝ inch face and a 0.281 inch hub on each side. The worm has a pitch diameter of 1.5 inches and has a dual thread. The relative hub dimension of the worm gear is important so that the worm will not rub the side of the cable.

Figure 4:
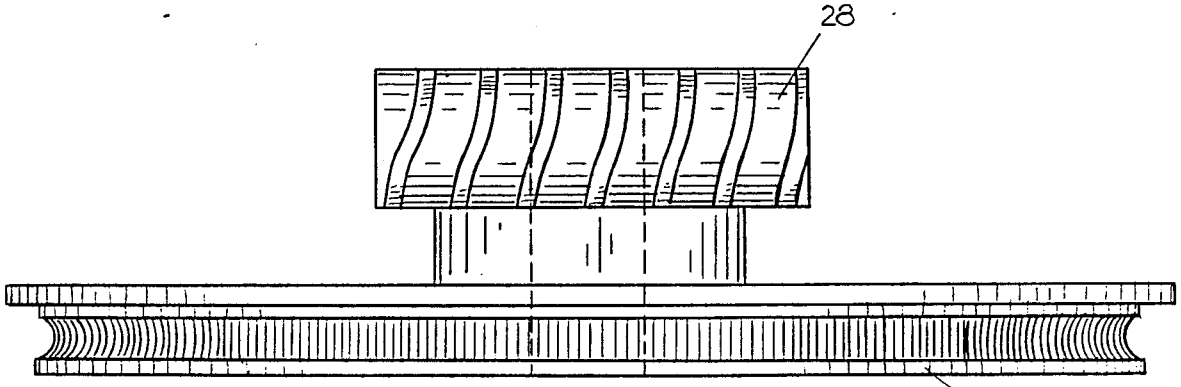
FIG. 4 is a side view of the worm gear cluster of the invention.

The cable sprocket 34 of the cluster gear has a diameter of 7.0 inches. In the illustrated embodiment, the cable sprocket 34 is similar to that of a Teleflex helm but with the worm gears 28 clustered therewith as illustrated in FIG. 4. The rotor or sprocket 34 is cut right hand thread with a 16° lead angle. The diameter of the cable 36 that the gear accepts is 0.3125 inches. The diameter of the cable wire wrap is 0.070 inches. The cable travel is 8.687 inches and the number of turns of the steering wheel rotation, in this embodiment, for complete steering port to starboard is 3.68 revolutions.

In another embodiment, the dual thread worm may be replaced with a single thread worm so the lead angle would be less than 5° in order to minimize or eliminate back drive. A guad thread worm could be used, but only in helms adapted for use with small motors, of less than 75 horsepower, for example.

To assemble the helm 10, the worm shaft 14 and its components are installed in the worm shaft housing 20 which is secured to the upper rotor housing 22. The stepped end 39 of the cluster gear shaft 40 is then fitted into the hole 38 in the upper rotor housing 22 and is secured therein by cap **39*a* and screw 39*b*. The cluster gear 28, 34 is placed onto shaft 40 so that it engages the worm 26. A washer 41 spaces the worm gear 28 from shaft end 39**.

The lower rotor housing 24 is then wafered to the upper rotor housing and a 0.250 inch bolt 42 is installed into the end of cluster gear shaft 40 to secure the housings together. This completes the assembly of the helm 10.

All parts of the helm may be either aluminum, die cast aluminum, nylon, zinc, plastic or stainless steel or the like so that the helm is non-magnetic and won't interfere with a magnetic compass.

The mounting hardware for the helm of the invention may be substantially the same as that used for conventional type helms.

The lead angle of the double thread worm 26 is cut to the industry standard of 9 degrees, 28 minute. Any lead angle substantially greater than that is not effective for eliminating back drive for motors above 75 horsepower. It has been found that a motor of any horsepower can be positively locked by using a single thread lead angle of less than 5°.

Figure 6:
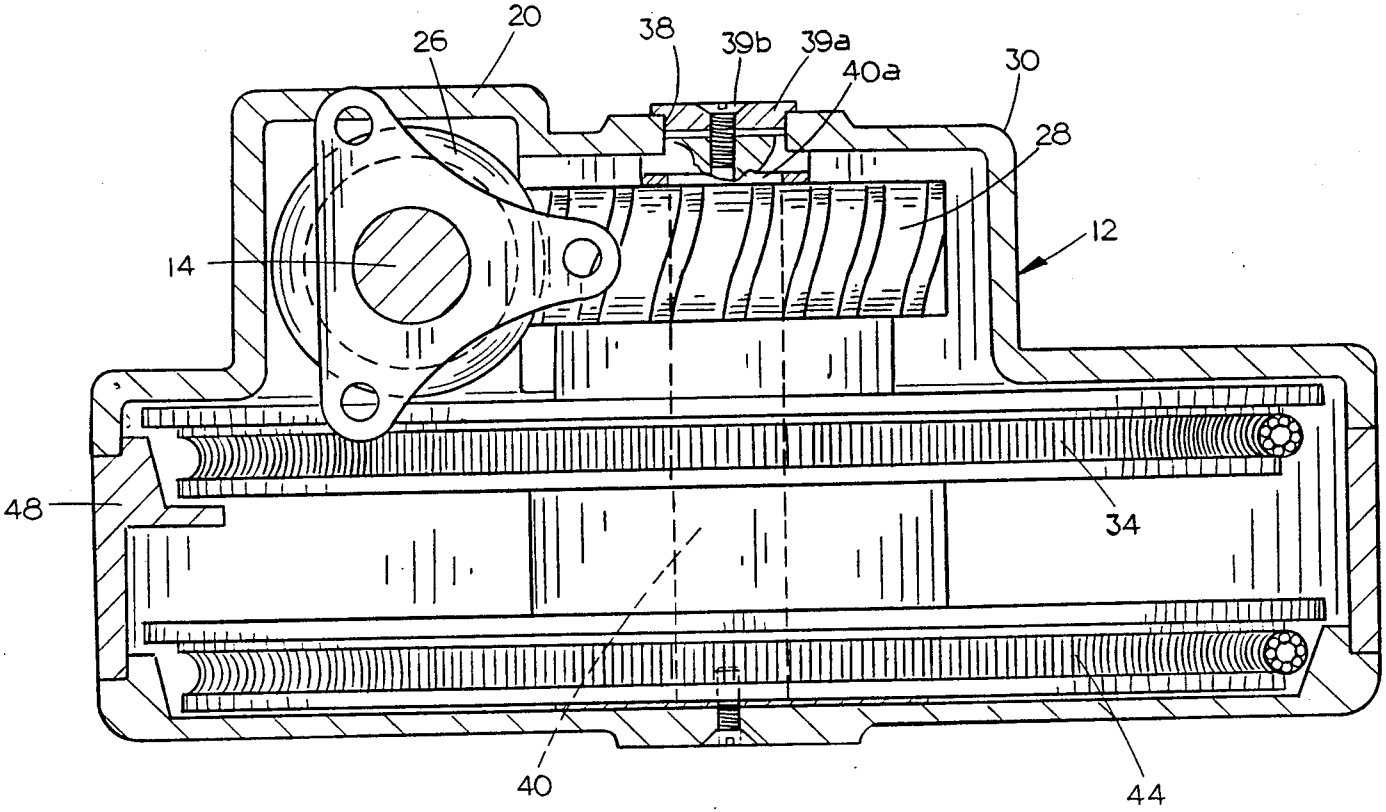
FIG. 6 is a side sectional view of an alternate embodiment equipped for dual steering.

FIG. 6 illustrates an alternate embodiment of the invention equipped for dual steering systems. Most of the structure illustrated in FIG. 6 is the same as that described in the previous embodiment and accordingly, like reference numerals are used to designate like parts of each. The primary difference is the addition of a second cable sprocket 44, which sprocket is arranged in spaced relation from the first cable sprocket 34 by a spacer block 46. The second cable sprocket 44 and spacer block 46 may be integrally formed with the first cluster gear 28, 34 or they may be secured thereto by bolts or other suitable fasteners. To afford room within the housing for both cable sprockets, a housing extension sleeve 48 is interposed between the upper rotor housing 22 and lower rotor housing 24. The cluster gear shaft 40 through the center of the housing in the previous embodiment is simply replaced by a longer shaft **40*a*** for securing the dual cable helm assembly together.

Whereas the invention has been shown and described in connection with two preferred embodiments thereof, it is understood that many additions, modifications and substitutions may be made which are within the intended broad scope of the appended claims.

An important feature of the present invention is the adaptation of the worm gear set for a mechanical cable drive helm. It is the worm gear set which affords the capability of the helm to hold a boat on a predetermined course in the event that human control of the boat is lost. This is because steering torque at the outdrive unit is not transmitted through the worm gear set to the steering wheel. Thus, the steering wheel will be virtually locked in any position in which it is set until it is manually turned to a different position.

Thus, there has been shown and described an improved mechanical helm which accomplishes at least all of the stated objectives.

I claim:

1. A self-locking mechanical steering helm for a boat having a conventional push-pull flexible cable type steering system, of the type having a steering wheel adapted for connection to the helm and a steering cable within a sheath extended forwardly from a steerable drive unit for connection to the helm, the sheath being mounted between the helm and drive unit to allow longitudinal movement of the cable therein, said helm comprising, a worm shaft housing;

a worm rotatably supported in said worm shaft housing, said worm having threads;

a worm shaft having opposite ends connected to said worm and steering wheel respectively, such that said worm and steering wheel rotate in unison;

a rotor housing for supporting a worm gear and cable sprocket;

a worm gear rotatably supported in said rotor housing in meshed relation with said worm;

a cable sprocket fixed to said worm gear for rotation in unison therewith, said sprocket being rotatably mounted in said rotor housing and adapted for receiving said steering cable in driven relation thereon;

said sheath having one end mounted to said rotor housing with said cable extending therefrom into said rotor housing;

said cable being operably connected to said steerable drive unit to steer the same in response to longitudinal movement of the cable within said sheath;

said cable being operably connected to said cable sprocket such that rotational movement of said sprocket moves the cable longitudinally within said sheath;

means for detachably connecting said worm shaft housing to said rotor housing with said worm gear in meshed relation with said worm;

said worm threads having a lead angle adapted to eliminate back drive by said worm gear; and said worm and gear being operative to freely transmit steering torque from said steering wheel to said steerable drive unit and to substantially eliminate transmission of steering torque from said steerable drive unit to said steering wheel.

2. The helm of claim 1 wherein said worm and worm shaft comprise aligned pin holes and a pin in said aligned pin holes for fixing said worm on the worm shaft for rotation in unison.

3. The helm of claim 1 wherein said rotor housing is split into upper and lower rotor housings along a plane generally perpendicular to the axis of said worm gear and cable sprocket and further comprising means for detachably securing said upper and lower rotor housings together.

4. The helm of claim 3 wherein said lower rotor housing further comprises a pair of cable guides positioned with generally parallel axes arranged generally tangent to opposite sides of the cable sprocket.

5. The helm of claim 3 further comprising a worm gear axis pin connected to and extended between said upper and lower rotor housings, said worm gear and cable sprocket being mounted on said worm gear axis pin.

6. The helm of claim 1, wherein said rotor housing includes an upper rotor housing, a lower rotor housing and a generally cylindrical housing extension sleeve interposed between said upper and lower rotor housings, and further comprising a second cable sprocket, means for operably securing said second cable sprocket to said cable sprocket for rotation in unison, and means for detachably securing said upper and lower rotor housings together, with said extension sleeve therebetween, so as to completely enclose said sprockets.

7. The helm of claim 1, wherein said worm is a double thread worm with threads having a lead angle of approximately 9 degrees 28 minutes or less, such that back drive is prevented.

8. The helm of claim 1, wherein said worm is a single thread worm with a lead angle of less than 5 degrees, such that back drive is prevented.

* * * * *